United States Patent [19]

Jaronen

[11] 4,247,753

[45] Jan. 27, 1981

[54] BATTERY OPERATED ELECTRIC HEATING DEVICE FOR THAWING FROZEN LOCKS

[76] Inventor: Niilo Jaronen, Lammasrinne 3 D 79, 01710 Vantaa 71, Finland

[21] Appl. No.: 951,834

[22] Filed: Oct. 16, 1978

[30] Foreign Application Priority Data

Oct. 20, 1977 [FI] Finland ..... 773109
Nov. 21, 1977 [FI] Finland ..... 773509

[51] Int. Cl.[3] ..... E05B 17/00; H05B 3/40; F21V 33/00

[52] U.S. Cl. ..... 219/201; 70/431; 219/202; 219/220; 219/221; 219/230; 219/237; 219/240; 219/533; 338/271; 362/92; 362/116

[58] Field of Search ..... 219/200, 201, 202, 220, 219/221, 227, 236, 237, 240, 230, 533; 338/240, 241, 271; 362/92, 117, 116; 70/431

[56] References Cited

U.S. PATENT DOCUMENTS

| | | | |
|---|---|---|---|
| 2,371,534 | 3/1945 | McGrath | 219/221 X |
| 2,898,571 | 8/1959 | Moule et al. | 338/271 X |
| 2,965,741 | 12/1960 | Blazina | 219/200 |
| 3,022,408 | 2/1962 | Wagner | 219/201 X |
| 3,450,859 | 6/1969 | Brucker | 219/201 |
| 3,536,890 | 10/1970 | Hombrecher | 219/229 X |
| 3,973,422 | 8/1976 | Cervera | 219/240 X |

FOREIGN PATENT DOCUMENTS

| | | | |
|---|---|---|---|
| 1430621 | 12/1968 | Fed. Rep. of Germany | 219/202 |
| 1375768 | 11/1974 | United Kingdom | 219/275 |

*Primary Examiner*—A. Bartis
*Attorney, Agent, or Firm*—Abraham Saffitz

[57] ABSTRACT

A battery operated portable thawing device for frozen locks has an electrically heated thawing stick sized for insertion into the key hole of a frozen lock. The stick is thinner than the lock key and comprises a hollow metal body inside which is located a thin resistance heating wire. The resistance wire is located between the middle and the end of the stick inserted into the keyhole in a relatively short length (20–30%) of the thawing stick. For use, the stick is slidable out of a protective housing adapted to be gripped in the hand. The housing carries a battery for energizing the stick and a light bulb for illuminating the keyhole. The metal body of the stick serves as one terminal for supplying current to the resistance wire. The circuit between the battery and resistance wire made automatically made when the stick is moved out of the housing for use and broken when the stick is returned into the housing.

2 Claims, 10 Drawing Figures

Fig. 3
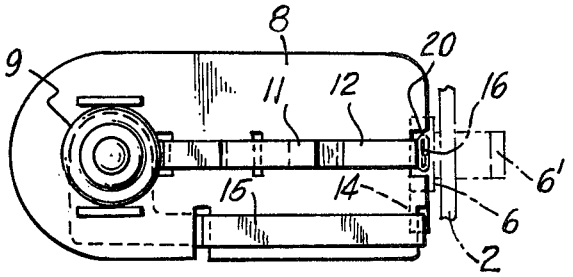
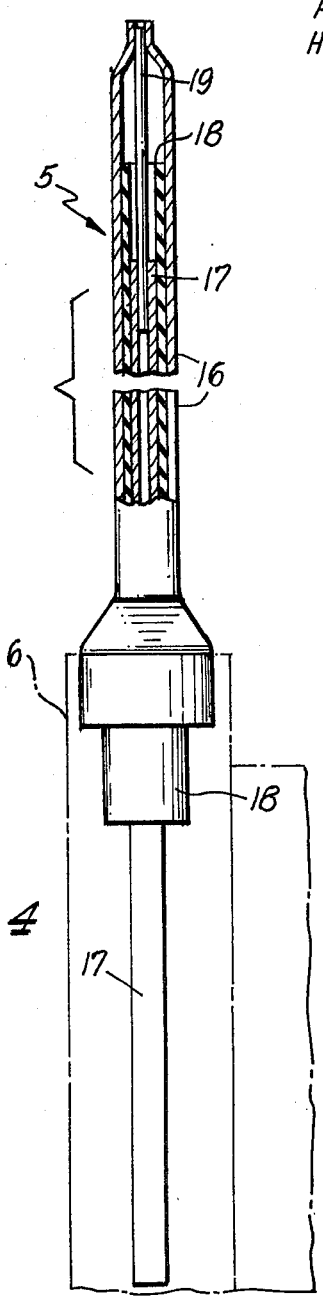
Fig. 4
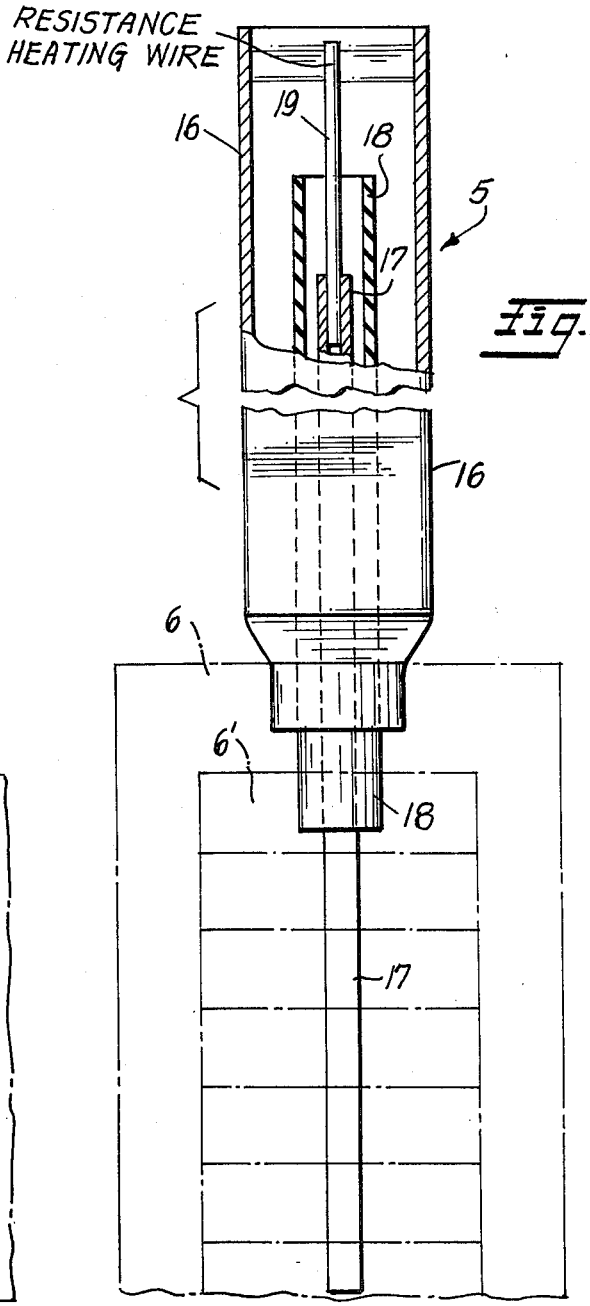
Fig. 5

BATTERY OPERATED ELECTRIC HEATING DEVICE FOR THAWING FROZEN LOCKS

BACKGROUND OF THE INVENTION

1. Field of the Invention

The present invention refers to a thawing means for frozen locks with an electrically heated thawing stick for insertion into the lock. The invention is specifically intended for thawing motor car locks in order to open or close them when moisture or water that has entered the lock has frozen so as to impede insertion of the key.

2. Description of the Prior Art

A number of different methods for opening frozen locks are known. At present, ice thawing and/or deicing agents sprayed into the lock through the key hole are most common. If the lock is badly frozen, thawing the lock with a deicing fluid takes time. Fluid also flows from the lock onto the car surface leaving an ugly trace. When the lock is so badly frozen that the cover plate in front of the key hole does not move away from the front, no fluid can enter the lock.

In addition, electrically heated keys, heating sticks as well as locks heated by electric resistance are known. Also known is a battery-operated heating plate which is pressed against the lock. These devices known in the prior art have been described, for instance, in the U.S. Pat. No. 3,022,408, in the German Pat. Publication No. 1.553.309 and in the German Pat. application No. 2.123.161.

OBJECTS OF THE INVENTION

The object of this invention is to provide a small-sized lock thawing means that can be carried in the pocket and is easy to use wherein effective heating of the thawing stick is obtained by means of small batteries. Current consumption in the battery operated embodiment must be low so as not to require frequent replacement of the battery or batteries. In addition, the thawing means must fit into locks of many different kinds.

SUMMARY OF THE INVENTION

The objects of the invention are achieved by a thawing means for frozen locks with an electrically heated thawing stick for insertion into the lock, wherein the thawing stick is thinner than and key and comprises a thin, hollow metal stick inside which is located at thin resistance heating wire, one end of the wire being connected to the metal case of the stick and the other end being connected by means of an insulated conductor inside the stick to a terminal which is connected to a current source.

Preferably, the resistance wire is between the middle and the tip of the thawing stick in a relatively short length of the thawing stick.

Advantageously, the length of the resistance wire from the tip of the stick maybe 20–30% of the total length of the stick and the effective length of the resistance wire is 10–50%, most suitably about 20% of the total length of the stick.

BRIEF DESCRIPTION OF THE DRAWINGS

In the following, embodiments of the invention are described in detail by way of example only, with reference to the attached drawings, in which

FIG. 3 is a plan view of the connecting plate showing the bulb and contact strips affixed thereto;

FIG. 4 is an enlarged and elevational view of the heating stick of the thawing device, partly in section, and with the slide actuator shown in phantom lines;

FIG. 5 is a front elevational view, partly in section, of the heating stick of FIG. 4;

DESCRIPTION OF PREFERRED EMBODIMENTS

Figure 1:
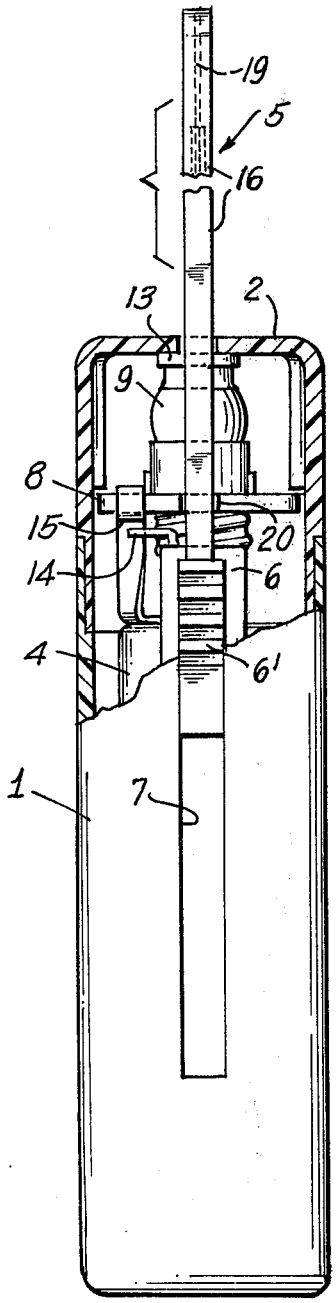
FIG. 1 is an end elevational view, partly in section, of the thawing device of the present invention.

The battery operated embodiment will be described first with reference to FIGS. 1–3.

The protective housing of the thawing means consists of the body member 1 and the cover member 2 mountable on the open upper end of the body member. The body member 1 is divided by a partition 3 in two compartments, one compartment receiving the torch batteries 4 and the other compartment the displacing member 6 of the thawing stick 5. A knurled part 6' of the displacing member 6 comes out from a longish opening 7 at the side of the housing 1. The thawing stick 5 can be pushed out of the housing and pulled back into the housing by means of displacing member 6, which slides along the partition 3 while being pressed against it. The cover member 2 receives a separate connecting plate 8 carrying a small incandescent bulb 9 below an opening 10 in the cover 2. The base of the bulb 9 is in permanent contact with the positive terminal of the left-hand battery 4, FIG. 2. The negative terminal of the right-hand battery 4, FIG. 2, is connected to the threaded part of bulb 9 by means of contact strips 11 and 12. The contact strip 11 urges by its own spring force the push-button 13 up. When the pushbutton 13 is pressed down, the end of contact strip 11 meets the contact strip 12, causing the circuit to bulb 9 to be closed. This switching arrangement is simple to manufacture but it serves well in the present case as a means of conserving the batteries. In addition to seeking the key hole to be thawed in the dark, bulb 9 can also be used for many other lighting purposes occurring when using the car.

The thawing stick 5 consists of a hollow flattened metal tube which is relatively thin as compared, for instance, with motor car keys. It therefore fits well into different kinds of locks. A resistance wire, which is heated by current from batteries 4, is placed within the hollow metal tube 5 in a way to be described in detail further on. The stick 5 itself serves with its outer surface as another contact surface, which slides in permanent contact along the contact strip 12. The connecting plate 8 has a notch 20 (FIG. 3) for receiving the stick 5. The other contact point 14 for connecting current to the heating resistance running inside the stick 5 is secured to the upper edge of the displacing member 6 in such way that when the displacing member 6 is in its upper position and the stick 5 has been pushed out of the housing for use, then the contact point 14 meets the end of the contact strip 15. The other end of contact strip 15 is located between the base of the bulb 9 and the positive terminal of the left-hand battery shown in FIG. 2.

The design of the thawing stick 5 is described in the following with reference to FIGS. 4 and 5. Within the flattened tubular metal case 16 which is of a size to fit into the keyhole of a lock there is placed a tube 18 of insulating material encircling a thin metal tube 17. A thin resistance wire 19 is fixed within the one end of the tube 17 which is within tube 16, the length of the wire being a relatively small part, in any case less than half and preferably less than one third, of the total length of the tube 16. The other end of the resistance wire 19 is fixed to the metal tube 16 by flattening the case end and/or by soldering. The unflattened end of the tube 16 with its protruding metal tube 17 is placed within the displacing member 6 and the end of the tube 17 meets the contact point 14. The flattend portion of tube 16 is adapted to engage terminals 12. In this way, a closed circuit is obtained via resistance wire 19 through parts 15, 14, 17, 19, 16 and 12. Also the tube 17 may be made of a suitable resistance that heats up at a certain current intensity, but added heating takes place in a very thin resistance wire 19, e.g. of 0.12 mm thickness, connected in a series with it. By this arrangement, a centralized heating effect is achieved near the tip of the stick where heating is needed most to make it possible for the stick to penetrate the ice and a small current consumption is needed as compared with an arrangement where the resistance causing the heating effect is accomplished by a greater length of the wire. Thus, it is possible to provide a compact, battery-operated, highly effective thawing means that can be carried in the pocket. The tubes 17 and 18 with resistance wire 19 are loosely placed within the metal case constituted by the tube 16 while it has a round cross section. Then the metal case constituted by the tube 16 is flattened in such a way that it is pressed against the insulating material tube 18, whereby tubes 18 and 17 become permanently fixed within the tube 16.

Figure 6:
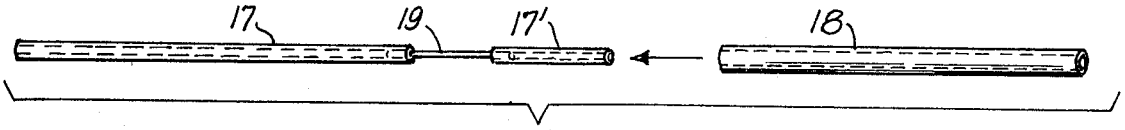
FIG. 6 is an enlarged exploded perpective view of the initial step of assembling a modified form of heating stick.
Figure 7:
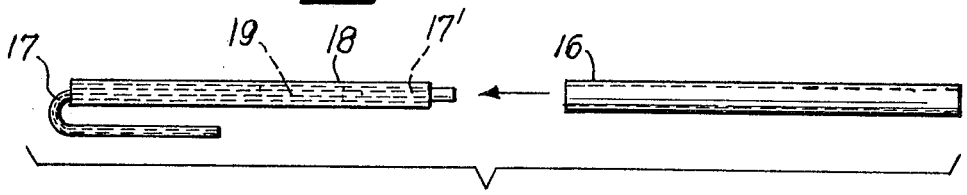
FIG. 7 is an exploded view of the next step in assembling the heating stick of FIG. 6.
Figure 8:
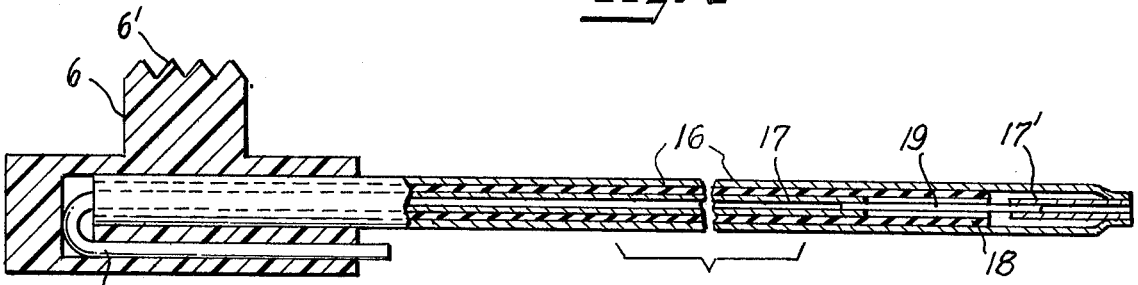
FIG. 8 is a further enlarged fragmentary sectional view, partly in elevation, of the final step in assembling the heating stick showing the slide attached thereto.

In order to prevent the resistance wire 19, against too strong fluctuations of temperature and in order to prevent contact disturbances in its juncture, a more advantageous construction of the thawing stick is shown in FIGS. 6 and 7.

Between the ends of two thin metal tubes 17 and 17' a thin resistance wire 19 is fixed by inserting the ends of the resistance wire a short distance into the tubes 17 and 17'. In the present example the length of the tube 17 is 53 mm, the length of the tube 17' is 15 mm and the effective length of the wire 19' is 10 mm. The heated part of the length of resistance wire 19 constitutes glowing part of the resistance wire 19 between tubes 17 and 17'. The insulating material tube 18 of Kaflon; a fluoropolymer which is heat resistant, the heat resistance of which is about +350° C., is pushed over parts 17', 19 and 17 and the free end of the tube 17 is bent, whereby the construction shown in FIG. 7 is achieved. The protective metal case 16 is pushed over this assembly and the stick 5 formed in this way is flattened in a way that the parts are fastened to each other, and a plastic sliding part 6, which functions as a handle, is fastened to the end of stick 5. The sliding part 6 is placed within the housing of the thawing means. Between the free end of the tube 17' and protective case 16, an electricity conducting contact is formed by flattening and/or by soldering.

Figure 2:
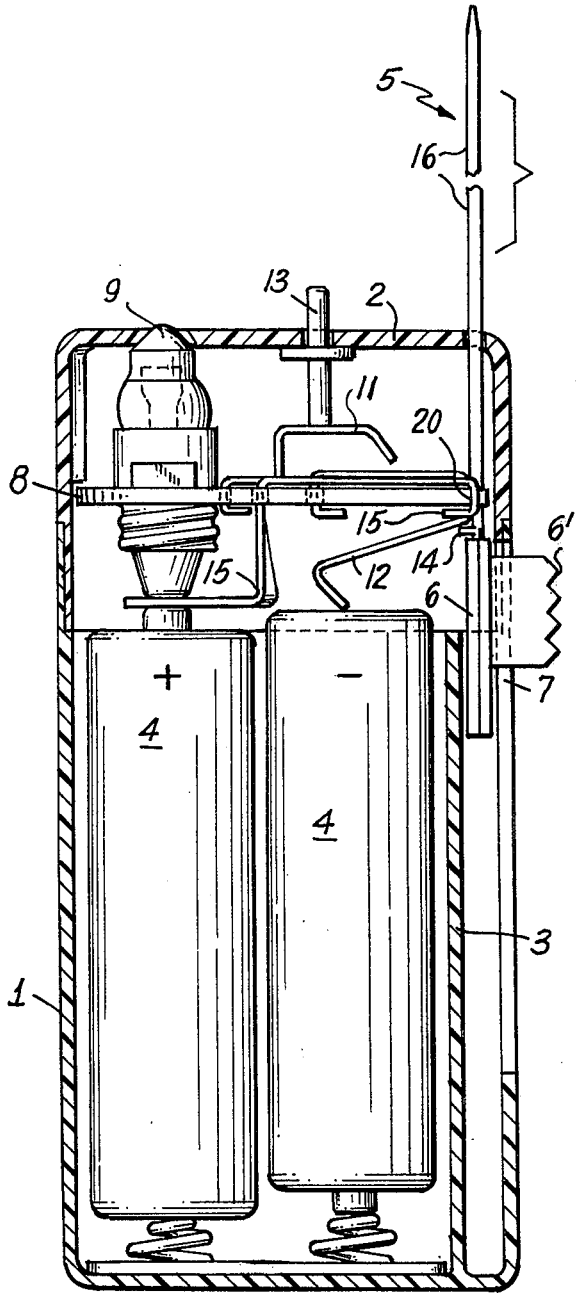
FIG. 2 is a vertical sectional view of the thawing device of FIG. 1.

The bent end of tube 17 extends through the displacing member 6 and is connected to a contact point such 14 in FIG. 2. Thus the outer surface of metal case 16 and the bent end of tube 17 cooperate with contact strips 12 and 15, respectively, to connect the resistance wire 19 in circuit with the batteries 4 when the thawing stick 5 is pushed out of protective housing in the manner described above.

Figure 9:
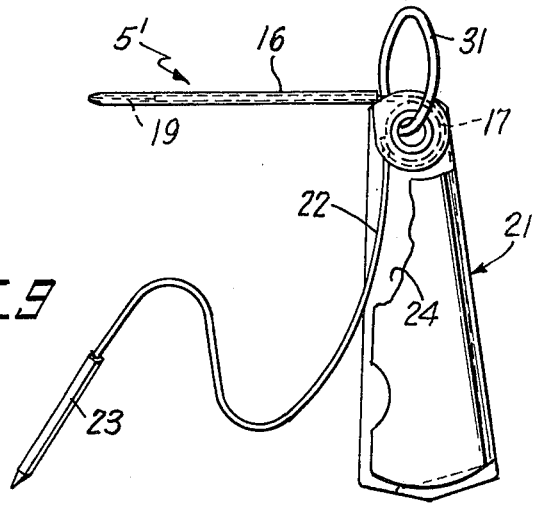
FIG. 9 is a side elevational of another embodiment of the thawing device showing a carrying case for the thawing device.
Figure 10:
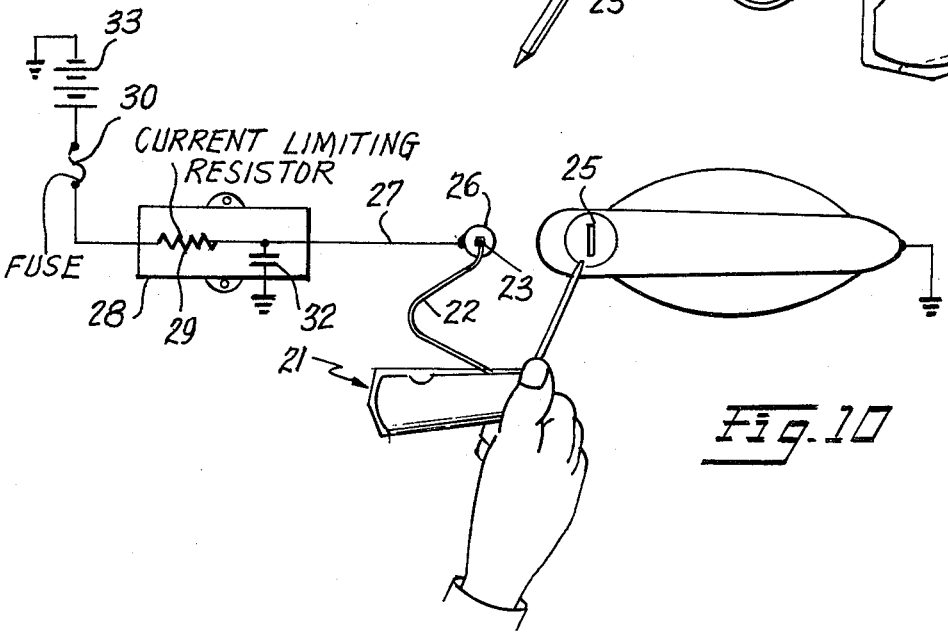
FIG. 10 is a diagrammatic illustration showing the embodiment of FIG. 9, together with a schematic wiring diagram for the thawing device.

FIGS. 9 and 10 show an embodiment of the thawing stick to be used with a car battery. The only difference in this thawing stick 5' is that the resistance wire can be three times thicker and its effective area slightly longer, however, less than 75% of the whole length of the stick. Also in this case the distance of the resistance wire from the tip of the stick should be 10–15% of the whole length of the stick 5'.

The lower part of the thawing stick 5' is fastened to the plastic piece 6', inside which the free end of the conductor 17 is connected to a cable 22, at the end of which there is provided a connecting plug 23. Piece 6' is pivotably mounted to the protective case 21 and the case is made hollow. Car keys may be hung on the key ring 31 and the hole in the case 21 serves as pivot shaft of the part 6'. The case 21 is hollow and open at one narrow side. From this open side the cable 22 can be pushed into the hollow space 24 of the case 21 and the stick 5' can be introduced into the open edge of the case 21 in order to close the hollow space 24.

If the frozen lock does not open with the key, the stick 5' is turned from inside the edge of the case 21 to the position shown in FIGS. 9 and 10 and the plug 23 is inserted into a socket 26, which is provided close to the key hole 25. When the metal surface of the stick 5' touches the metal surface of the lock, the circuit is completed and the resistance wire 19 inside the stick 5' becomes hot. The stick 5' can be pushed in the key hole 25 and when penetrating the hole it thaws the ice. The stick 5' is kept in the key hole for some time, and after removal the door can be opened with the key.

The socket 26 is connected to the car battery 33 by means of a conductor 27. A fuse 30 can be situated in the normal fuse box of the car. Additionally, there is provided a box 28 with a current limiting series resistor 29 and a spark condenser 32, which prevents sparking between stick 5' and the lock when opening the circuit.

What I claim is:

1. A battery operated electrically heated thawing device for insertion into the keyhole of frozen locks comprising:

a thawing stick in the form of a thin hollow flattened elongated metal body having a height and width which is less than the thickness of the key fitting into the keyhole thereby adapting said stick for insertion into the keyhole;

a thin electrical heating resistance wire fitted into the hollow interior portion of said metal body and extending from the longitudinal center of said body to the tip of said stick adapted to be inserted into the keyhole, the heating wire and metal body being in electrical contact with each other at said tip;

the remainder of said resistance wire being electrically insulated from said metal body by means of a layer of insulation interposed between said wire and the inner surface of said body;

at least one battery for supplying electric power to said resistance wire in said thawing stick;

a common protective housing open at the top and of generally rectangular shape and of a size to be gripped in the hand, said open to being closed by a cover member, said housing encasing said at least one battery and said thawing stick in side by side relation;

said common housing provided with a vertical partition defining a well between a wall of said housing and said partition, said thawing stick being slideably mounted for vertical displacement into and out of said well and said at least one battery being located between the other side of said vertical partition and the opposite wall of said housing;

said cover member having an opening above said well allowing for vertical displacement of said stick from said well through said opening for insertion of the tip of said stick into a keyhole;

a horizontal plate within said casing over said at least one battery having a pair of spring contacts on the under side to make electrical contact with the poles of said at least one battery and having an opening for retaining a bulb serving as a light to illuminate the key hole, said cover member having an opening in registery with the lamp;

a displacement means within said well connected to said thawing stick for slidingly moving said thawing stick through said opening in said cover member above said well;

said protective housing having an opening in the side thereof in communication with said well;

said displacement means having a knurled outer portion exposed through said side opening and serving as a handle for vertically sliding said thawing stick in the well of said housing along said partition with said stick is pressed against said vertical partition during the sliding movement of said stick;

said displacement means having an exposed contact member electrically connected to the end of said resistance wire means at the longitudinal center of said body, said spring contacts each terminating in electrical contact strip, one strip being in constant sliding engagement with said metal body of said stick, the other strip being arranged to be engaged by said contact member when said thawing stick is vertically displaced from said well through said cover member opening for use, means including a switch in said housing for selectively energizing said bulb from said at least one battery; and the length of said resistance wire measuring about 20 to 30% of the length of said stick whereby the electrical heating of said wire by said battery confines the heating to the tip of said stick which is inserted into said keyhole

2. A thawing device as claimed in claim 1 including an on-off button for actuating said switch to light said bulb.

* * * * *